US011783981B2

(12) United States Patent
Sakai

(10) Patent No.: US 11,783,981 B2
(45) Date of Patent: Oct. 10, 2023

(54) COIL COMPONENT

(71) Applicant: Murata Manufacturing Co., Ltd., Kyoto-fu (JP)

(72) Inventor: Takashi Sakai, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 440 days.

(21) Appl. No.: 16/985,217

(22) Filed: Aug. 4, 2020

(65) Prior Publication Data

US 2021/0043354 A1 Feb. 11, 2021

(30) Foreign Application Priority Data

Aug. 5, 2019 (JP) ..... 2019-143745

(51) Int. Cl.

| | |
|---|---|
| ***H01F 17/00*** | (2006.01) |
| ***H01F 17/04*** | (2006.01) |
| ***H01F 27/32*** | (2006.01) |
| ***H01F 41/04*** | (2006.01) |
| ***H01F 27/29*** | (2006.01) |

(52) U.S. Cl.

CPC ..... *H01F 17/0013* (2013.01); *H01F 17/04* (2013.01); *H01F 27/292* (2013.01); *H01F 27/324* (2013.01); *H01F 41/041* (2013.01); *H01F 2017/048* (2013.01)

(58) Field of Classification Search

CPC .... H01F 17/0013; H01F 17/04; H01F 17/292; H01F 27/324; H01F 41/041; H01F 2017/048

See application file for complete search history.

(56) References Cited

U.S. PATENT DOCUMENTS

2003/0134612 A1* 7/2003 Nakayama ..... H01F 17/0013 455/306
2004/0084131 A1* 5/2004 Konoue ..... H01F 41/046 156/89.12

(Continued)

FOREIGN PATENT DOCUMENTS

JP 2002043156 A 2/2002
JP 2009-302580 A 12/2009

(Continued)

OTHER PUBLICATIONS

An Office Action; "Notice of Reasons for Refusal," mailed by the Japanese Patent Office dated Apr. 5, 2022, which corresponds to Japanese Patent Application No. 2019-143745 and is related to U.S. Appl. No. 16/985,217 with English language translation.

*Primary Examiner* — Marlon T Fletcher
*Assistant Examiner* — Malcolm Barnes
(74) *Attorney, Agent, or Firm* — Studebaker & Brackett PC

(57) ABSTRACT

A coil component is provided in which the insulation between coil conductor layers can be enhanced. The coil component includes an element body; and a coil provided in the element body and spirally wound along a first direction. The coil has a plurality of coil conductor layers stacked along the first direction. The element body has a first area between the coil conductor layers adjacent to each other along the first direction in the element body, and has a second area other than the first area. The first area has a pore area rate less than a pore area rate in at least a part of the second area.

17 Claims, 6 Drawing Sheets

(56) References Cited

U.S. PATENT DOCUMENTS

| | | | | |
|---|---|---|---|---|
| 2010/0201473 | A1* | 8/2010 | Konoue | H01F 17/0013 336/200 |
| 2010/0225437 | A1* | 9/2010 | Ueda | H01F 17/04 336/200 |
| 2012/0326827 | A1* | 12/2012 | Nanjyo | H01F 17/0033 336/200 |
| 2015/0235753 | A1* | 8/2015 | Chatani | H01F 41/046 336/200 |
| 2016/0314891 | A1* | 10/2016 | Onozaki | H01F 41/041 |

FOREIGN PATENT DOCUMENTS

| | | | | |
|---|---|---|---|---|
| JP | 2010-040860 | A | | 2/2010 |
| JP | 2010040860 | A | * | 2/2010 |
| JP | 2012-195471 | A | | 10/2012 |

* cited by examiner

COIL COMPONENT

CROSS-REFERENCE TO RELATED APPLICATION

This application claims benefit of priority to Japanese Patent Application No. 2019-143745, filed Aug. 5, 2019, the entire content of which is incorporated herein by reference.

BACKGROUND

Technical Field

The present disclosure relates to a coil component.

Background Art

Conventionally, examples of a coil component include one described in Japanese Patent Application Laid-Open No. 2002-043156. This coil component includes an element body and a coil in the element body. The element body includes a plurality of insulating layers that are stacked, and the coil includes a plurality of coil conductor layers that are stacked.

SUMMARY

However, for the above-described conventional coil component, sufficient measures have not been taken to ensure the electrical insulation between the coil conductor layers adjacent to each other in the stacking direction, and it has been found that there is a possibility that sufficient insulation between the coil conductor layers cannot be ensured particularly when the insulating layer between the coil conductor layers is thin.

Accordingly, the present disclosure provides a coil component in which the insulation between coil conductor layers can be enhanced.

The coil component according to the present disclosure includes an element body; and a coil provided in the element body and spirally wound along a first direction. The coil has a plurality of coil conductor layers stacked along the first direction. the element body has a first area between the coil conductor layers adjacent to each other along the first direction and having a second area other than the first area. The first area has a pore area rate less than a pore area rate in at least a part of the second area.

Here, the term "pore area rate" means the rate of the area of pores per unit area in a predetermined range in a section of an element body along the first direction.

According to the coil component of the present disclosure, because the pore area rate in the first area is small, pores that serve as a current path can be reduced between the coil conductor layers adjacent to each other along the first direction, and the electrical insulation between the coil conductor layers adjacent to each other can be enhanced. In particular, even when the thickness of the element body present between the coil conductor layers adjacent to each other along the first direction is thin, the insulation between the coil conductor layers adjacent to each other along the first direction can be maintained.

Furthermore, in one embodiment of the coil component, the element body has a vicinity area located in a vicinity of each of the coil conductor layers. The second area includes an out-of-vicinity area other than the first area. The out-of-vicinity area is located outside the vicinity area. The pore area rate in the first area is less than a pore area rate in the out-of-vicinity area, and a pore area rate in the vicinity area is less than the pore area rate in the out-of-vicinity area.

Here, the term "vicinity area" means an area that is located in the vicinity of the coil conductor layer and is present within 20 μm from the surface of the coil conductor layer in the element body.

According to the above-described embodiment, the leak generated between the coil conductor layers can be further suppressed. In particular, the leak can be suppressed not only from the opposing faces of the coil conductor layers adjacent to each other, but also from the side of the coil conductor layers.

Furthermore, in one embodiment of the coil component, the second area includes a central area located around a central axis of the coil, and the pore area rate in the first area is less than a pore area rate in the central area.

Here, the term "central area" means an area within a predetermined range from the central axis of the coil when viewed along the first direction of the coil.

According to the above-described embodiment, the pore area rate in the central area of the element body can be increased, the dissipation of the heat generated by the coil can be improved, and the internal stress can be relaxed by the pores even when heat or external stress is applied to the element body.

Furthermore, in one embodiment of the coil component, the pore area rate in the first area is 1% or less.

According to the above-described embodiment, the electrical insulation between the coil conductor layers can be further enhanced, and the internal stress can be relaxed by the pores even when heat or external stress is applied to the element body.

Furthermore, in one embodiment of the coil component, the pore area rate in the first area is 0.5% or less.

According to the above-described embodiment, the insulation between the coil conductor layers adjacent to each other can be further maintained.

Furthermore, in one embodiment of the coil component, a difference between the pore area rate in the first area and the pore area rate in at least a part of the second area is 1% or more.

According to the above-described embodiment, the electrical insulation between the coil conductor layers can be further enhanced, and the internal stress can be relaxed by the pores even when heat or external stress is applied to the element body.

Furthermore, in one embodiment of the coil component, the pore area rate in at least a part of the second area is 2% or more and 8% or less (i.e., from 2% to 8%).

According to the above-described embodiment, the insulation between the coil conductor layers adjacent to each other can be further maintained, and the internal stress can be further relaxed.

Furthermore, in one embodiment of the coil component, the element body further includes a void. The void is located between the coil conductor layers adjacent to each other along the first direction, and is in contact with one coil conductor layer of the coil conductor layers adjacent to each other.

According to the above-described embodiment, the electrical insulation between the coil conductor layers can be enhanced, and in the coil component, the stress on the element body can be suppressed. The stress is caused by the difference between the thermal expansion coefficients of the coil conductor layer and the element body, and is due to the change in the temperature of the coil conductor layer.

The coil component according to the present disclosure provides a coil component in which the insulation between the coil conductor layers can be ensured.

DETAILED DESCRIPTION

Figure 1:
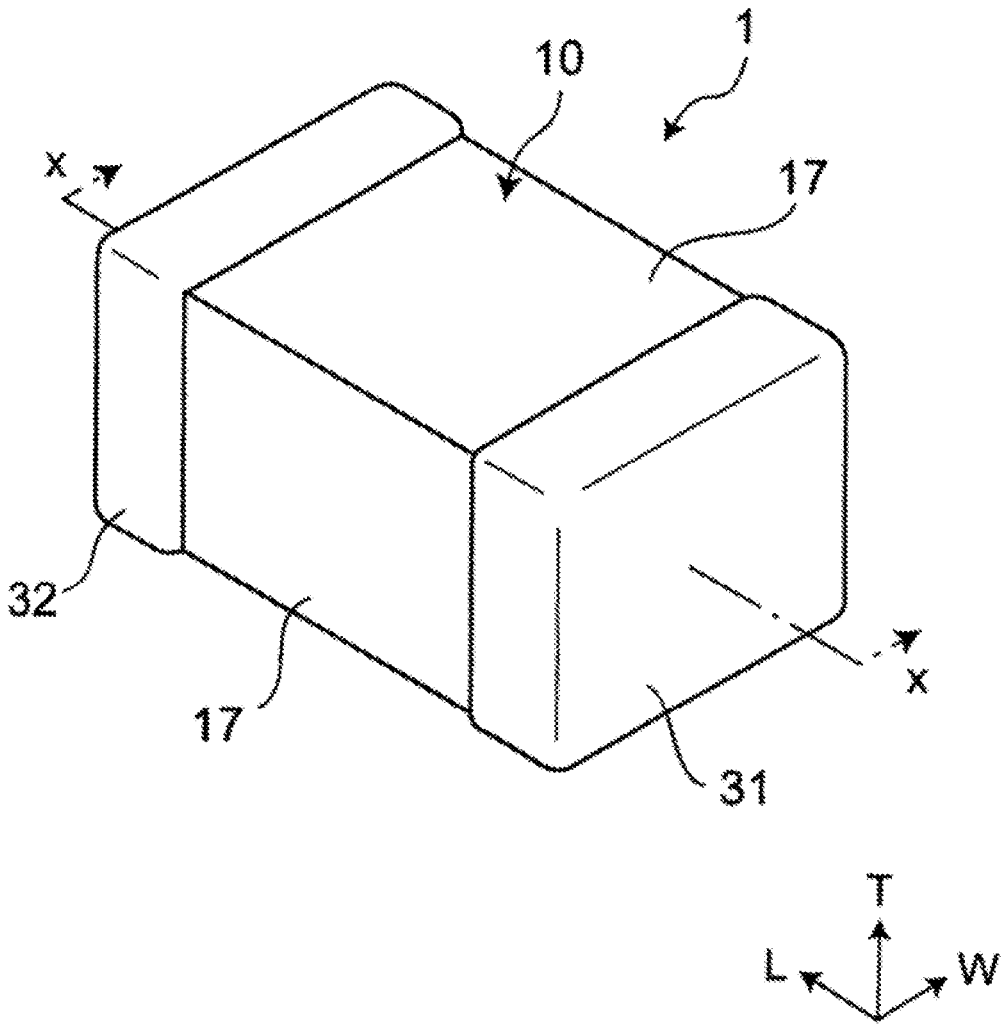
FIG. 1 is a perspective view showing a first embodiment of a coil component.

Hereinafter, a coil component that is one aspect of the present disclosure will be described in detail with reference to the embodiments shown in the drawings. Note that the drawings include some schematic ones and sometimes do not reflect actual dimensions or ratios.

First Embodiment

Figure 2:
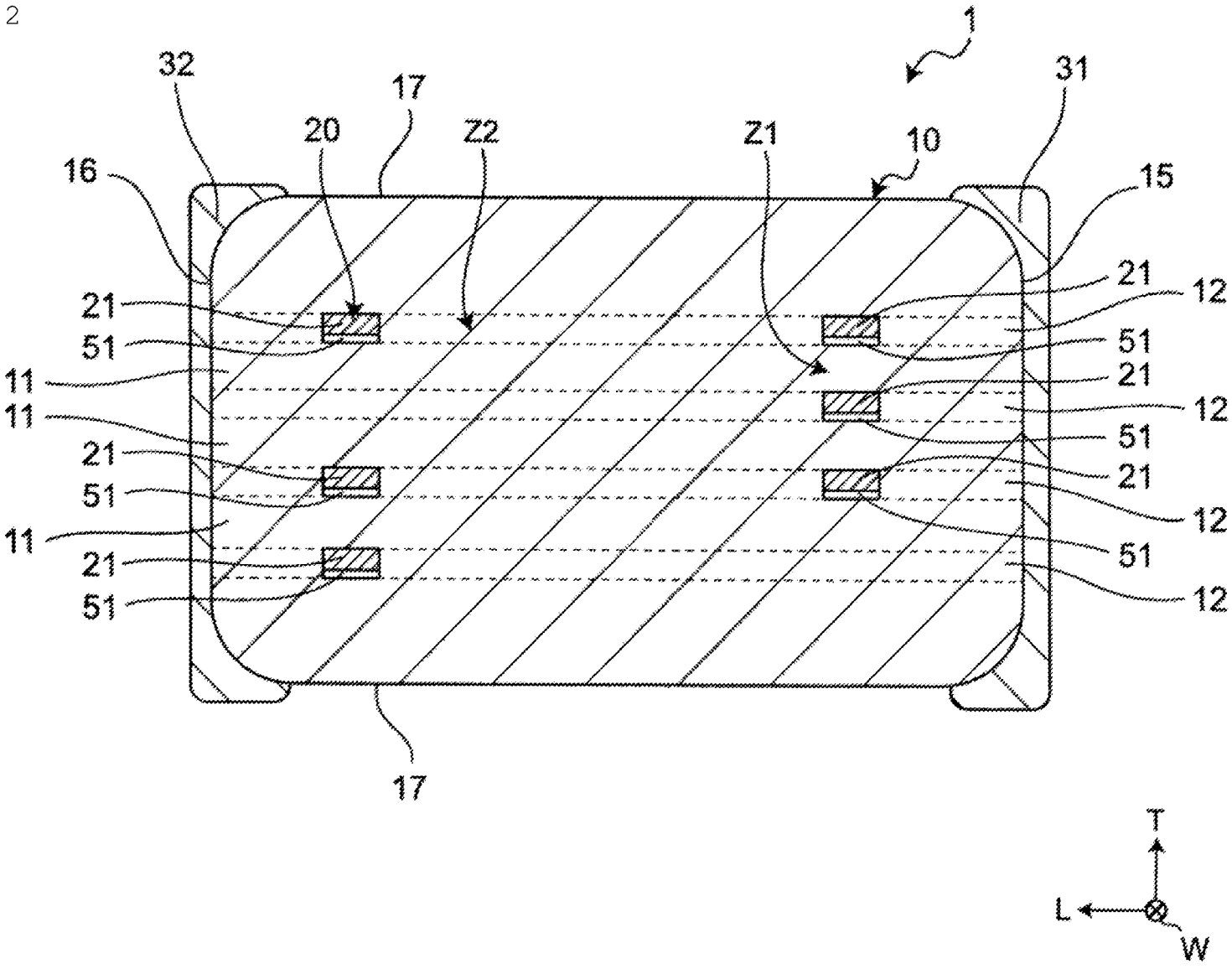
FIG. 2 is a sectional view taken along the line X-X of the coil component in FIG. 1.
Figure 3:
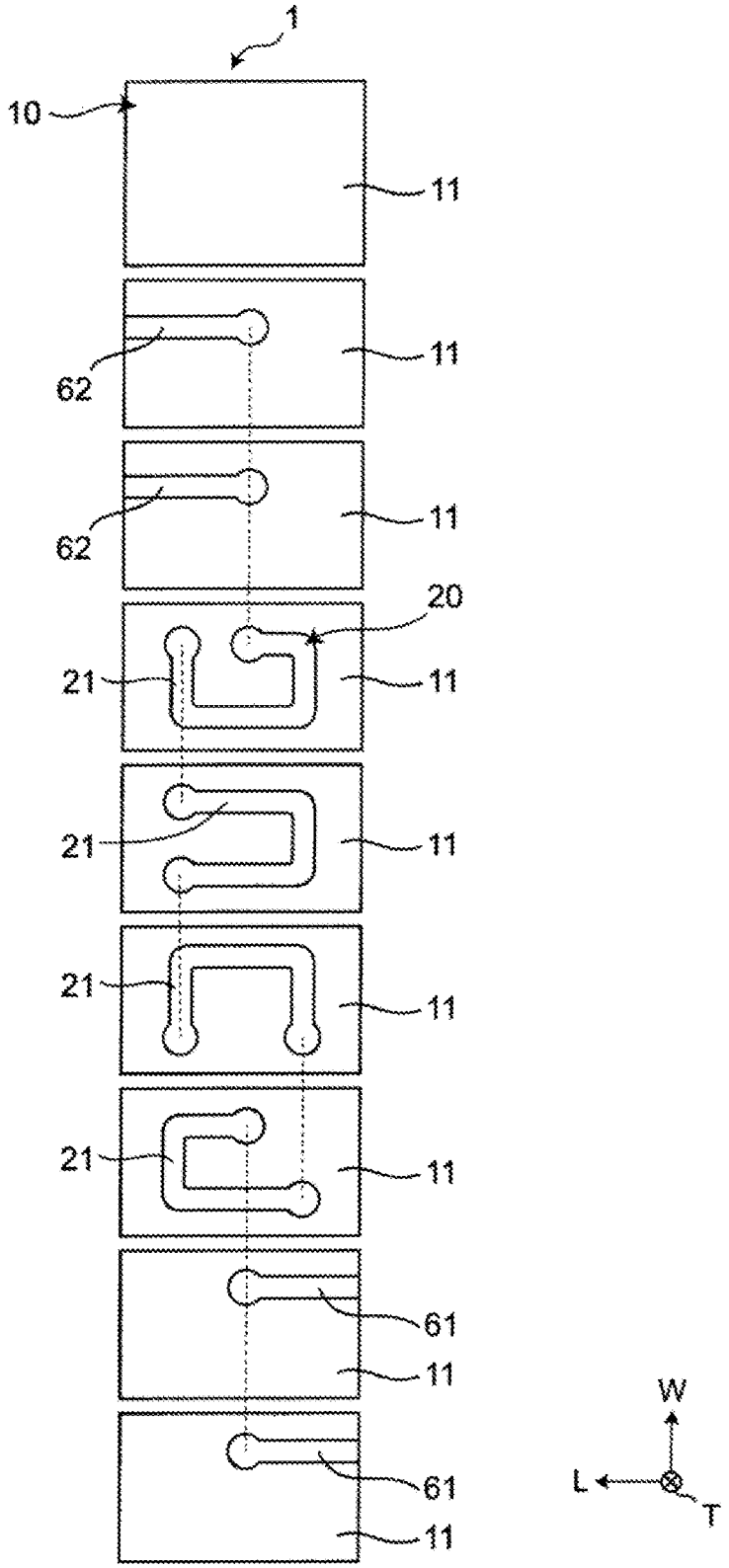
FIG. 3 is an exploded plan view of a coil component.

FIG. 1 is a perspective view showing a first embodiment of the coil component. FIG. 2 is a sectional view taken along the line X-X of the first embodiment shown in FIG. 1, and is a sectional view in the LT plane passing through the center along the W axis. FIG. 3 is an exploded plan view of the coil component, and shows views from the bottom view to the top view along the T axis. The L axis is in the length direction of a coil component 1, the W axis is in the width direction of the coil component 1, and the T axis is in the height direction of the coil component 1 (the first direction).

As shown in FIG. 1, the coil component 1 has an element body 10, a coil 20 provided inside the element body 10, and a first external electrode 31 and a second external electrode 32 that are provided on the surface of the element body 10 and electrically connected to the coil 20.

The coil component 1 is electrically connected to the wire of a circuit board (not shown) via the first external electrode 31 and the second external electrode 32. The coil component 1 is used, for example, as a noise removal filter, and is used in electronic devices such as personal computers, DVD players, digital cameras, TVs, mobile phones, and car electronics.

The element body 10 is formed into a substantially rectangular parallelepiped shape. The surface of the element body 10 has a first end face 15, a second end face 16 located on the side opposite from the first end face 15, and four sides 17 located between the first end face 15 and the second end face 16. The first end face 15 and the second end face 16 face each other along the L axis.

As shown in FIG. 2, the element body 10 includes a plurality of first magnetic layers 11 and second magnetic layers 12. The first magnetic layer 11 and the second magnetic layer 12 are alternately stacked along the T axis. The first magnetic layer 11 and the second magnetic layer 12 include a magnetic material such as a Ni—Cu—Zn-based ferrite material. The first magnetic layer 11 and the second magnetic layer 12 each have a thickness of, for example, 5 μm or more and 30 μm or less (i.e., from 5 μm to 30 μm). The element body 10 may include a nonmagnetic layer in part.

The first external electrode 31 covers the entire surface of the first end face 15 of the element body 10 and the ends of the sides 17 of the element body 10 on the first end face 15 side. The second external electrode 32 covers the entire surface of the second end face 16 of the element body 10 and the ends of the sides 17 of the element body 10 on the second end face 16 side. The first external electrode 31 is electrically connected to a first end of the coil 20, and the second external electrode 32 is electrically connected to a second end of the coil 20.

The first external electrode 31 may have an L-shape formed over the first end face 15 and one side 17, and the second external electrode 32 may have an L-shape formed over the second end face 16 and one side 17.

As shown in FIGS. 2 and 3, the coil 20 is spirally wound along the T axis. The coil 20 includes a conductive material such as Ag or Cu. The coil 20 has a plurality of coil conductor layers 21 and a plurality of extended conductor layers 61 and 62. Note that in FIG. 3, the second magnetic layer 12 is omitted.

The two first extended conductor layers 61, the plurality of coil conductor layers 21, and the two second extended conductor layers 62 are placed in order along the T axis and electrically connected in order via a via conductor. The plurality of coil conductor layers 21 are connected in order along the T axis to form a spiral along the T axis. The first extended conductor layer 61 is exposed from the first end face 15 of the element body 10 and connected to the first external electrode 31, and the second extended conductor layer 62 is exposed from the second end face 16 of the element body 10 and connected to the second external electrode 32. The number of the first extended conductor layers 61 and the number of the second extended conductor layers 62 are not particularly limited, and may be, for example, one.

The coil conductor layer 21 is formed into a shape wound on a plane with less than one turn. The extended conductor layers 61 and 62 are formed into a linear shape. The coil conductor layer 21 has a thickness of, for example, 10 μm or more and 40 μm or less (i.e., from 10 μm to 40 μm). The first extended conductor layer 61 and the second extended conductor layer 62 have a thickness of, for example, 10 μm or more and 30 μm or less (i.e., from 10 μm to 30 μm), and the thickness may be less than that of the coil conductor layer 21.

In the element body 10, a void 51 may be present. The void 51 is located between the coil conductor layer 21 and the first magnetic layer 11. The void 51 is provided so as to be in contact with the lower face of the coil conductor layer 21. The void 51 is provided along the entire surface of the interface between the coil conductor layer 21 and the first magnetic layer 11, and may be provided along a part of the interface. The maximum thickness of the void 51 is, for example, 0.5 μm or more and 8 μm or less (i.e., from 0.5 μm to 8 μm).

The void 51 may be located between the coil conductor layer 21 and the second magnetic layer 12.

By providing the void 51, the stress on the magnetic layers 11 and 12 can be suppressed. The stress is caused by the difference between the thermal expansion coefficients of the coil conductor layer 21 and the magnetic layers 11 and 12, and is due to the change in the temperature of the coil conductor layer 21. As a result, the deterioration of the inductance and the impedance characteristics due to the internal stress can be eliminated. As described below, in the coil component according to the present disclosure, because the pore area rate in the first area is small, the electrical insulation between the coil conductor layers is ensured even when the void is provided.

Figure 4:
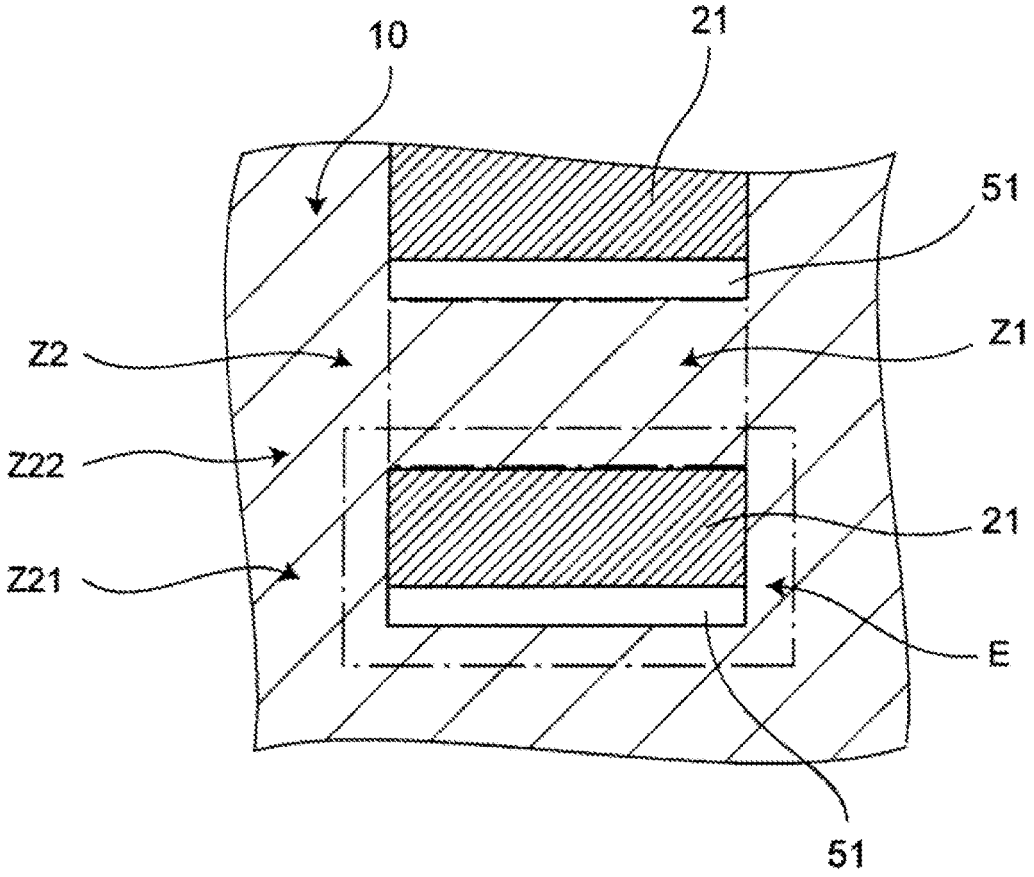
FIG. 4 is an enlarged sectional view around the coil conductor layer in FIG. 2.
Figure 5A:
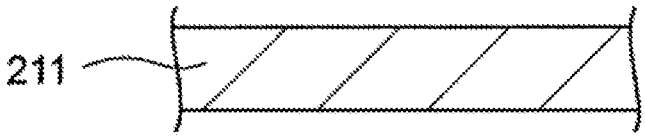
FIG. 5A is an explanatory view illustrating an example of a method for manufacturing a coil component.
Figure 5B:
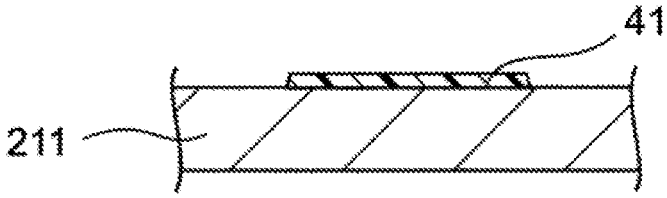
FIG. 5B is an explanatory view illustrating an example of the method for manufacturing a coil component.
Figure 5C:
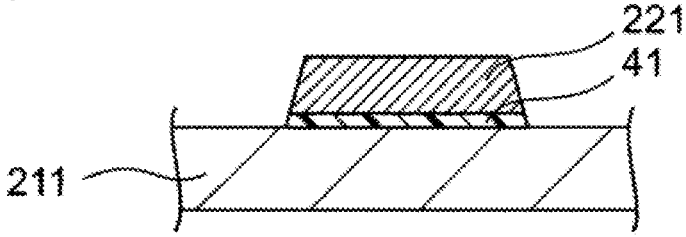
FIG. 5C is an explanatory view illustrating an example of the method for manufacturing a coil component.
Figure 5D:
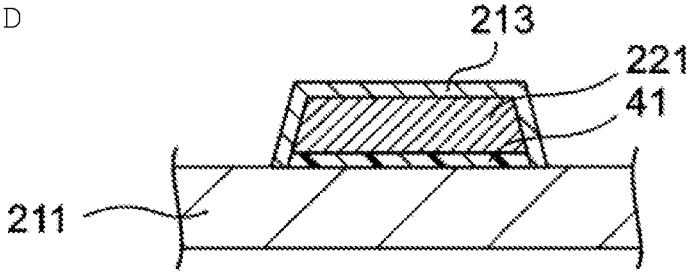
FIG. 5D is an explanatory view illustrating an example of the method for manufacturing a coil component.
Figure 5E:
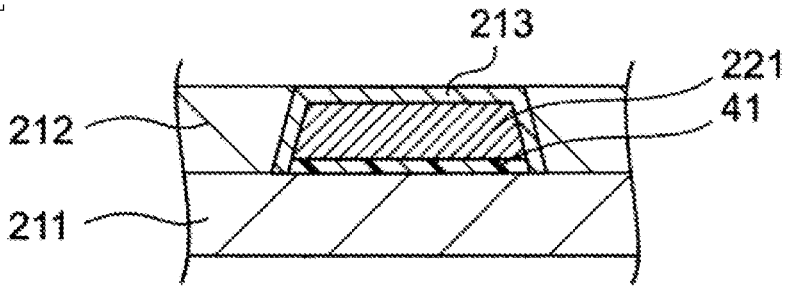
FIG. 5E is an explanatory view illustrating an example of the method for manufacturing a coil component.

FIG. 4 is an enlarged sectional view around the coil conductor layer 21 in FIG. 2. FIG. 4 shows a section in the width direction of the coil conductor layer 21, in other words, a section orthogonal to the extending direction of the coil conductor layer 21.

As shown in FIG. 4, the element body 10 has a first area Z1 and a second area Z2. The first area Z1 shows an area between the coil conductor layers 21 adjacent to each other along the T axis in the element body 10. FIG. 4 shows an example of the first area Z1 as an area surrounded by an alternate long and short dash line between the opposing faces of the coil conductor layers 21 adjacent to each other. The second area Z2 shows an area other than the first area Z1 in the element body 10.

The pore area rate in the first area Z1 is less than the pore area rate in at least a part of the second area Z2. Here, the term "pore area rate" means the rate of the area of pores per unit area in a predetermined range in a section of the element body 10. Specifically, the section used for measuring the pore area rate is an LT plane in the coil component 1 and a plane passing through the center of the coil component 1 along the W axis. The center includes not only the perfect center but also the almost center.

The pore area rate is measured as described below. The section that is an LT plane in the coil component 1 and a plane passing through the center of the coil component 1 along the W axis is subjected to focused ion beam processing (FIB processing). The FIB processing is performed by vertically standing the sample to be measured and, if necessary, solidifying the periphery of the sample with a resin. The section that is an LT plane to be measured can be prepared by polishing the sample with a polishing machine along the W axis of the sample to a depth at which a substantially central portion along the W axis is exposed. Here, the FIB processing is performed using an FIB processing device SM13050R manufactured by SII Nano Technology Inc. Then, a scanning electron microscope (SEM) photograph is taken of the prepared section. The obtained SEM photograph is analyzed using image analysis software to determine the pore area rate. As the image analysis software, "A-zo kun" (registered trademark) manufactured by Asahi Kasei Engineering Corporation is used.

Because the pore area rate in the first area Z1 is small, pores that serve as a current path can be reduced between the coil conductor layers 21 adjacent to each other along the T axis, and the insulation between the coil conductor layers adjacent to each other can be enhanced. In particular, even when the thickness of the element body present between the coil conductor layers 21 adjacent to each other along the T axis (that is, the magnetic layer) is thin, the insulation between the coil conductor layers 21 adjacent to each other along the T axis can be maintained.

The pore area rate in the first area Z1 is, for example, 1% or less, and specifically, 0.5% or less. As a result, the pores that serve as a current path can be further reduced between the coil conductor layers 21 adjacent to each other, and the insulation between the coil conductor layers 21 adjacent to each other can be further enhanced. In particular, even when the thickness of the layer present between the coil conductor layers 21 is thin, the insulation between the coil conductor layers 21 adjacent to each other can be further maintained.

The pore area rate in the second area Z2 is, for example, 1% or more, or 1.5% or more, and specifically 2% or more and 8% or less (i.e., from 2% to 8%).

Even when the pore area rate in the second area Z2 is a value as described above, the insulation in the coil component according to the present disclosure can be maintained without any problem. Furthermore, because the pore area rate in the second area Z2 is a value as described above, the internal stress can be relaxed by the pores even when heat or an external stress is applied to the element body 10.

The difference between the pore area rate in the first area Z1 and the pore area rate in at least a part of the second area Z2 is, for example, 1% or more, and specifically 2% or more.

As a result, the electrical insulation between the coil conductor layers 21 can be further enhanced, and the internal stress can be relaxed by the pores even when heat or external stress is applied to the element body 10.

The size of the pore is not particularly limited, and is, for example, 0.7 μm or less, and specifically 0.6 μm or less. The lower limit of the size of the pore is, for example, 0.05 μm.

The shape of the pore is not particularly limited, and the section can substantially have, for example, a circular shape, an elliptical shape, a polygonal shape, or the like.

In another aspect, the element body 10 has a vicinity area E located in the vicinity of the coil conductor layer 21, and the second area Z2 includes an out-of-vicinity area that is other than the first area and is located outside the vicinity area. It is preferable that the pore area rate in the first area be less than the pore area rate in the out-of-vicinity area, and the pore area rate in the vicinity area be less than the pore area rate in the out-of-vicinity area.

As a result, the leak generated between the coil conductor layers 21 can be further suppressed. In particular, the leak can be suppressed not only from the opposing faces of the coil conductor layers adjacent to each other, but also from the side of the coil.

Here, the vicinity area E is present within 20 μm from the surface of the coil conductor layer 21 in the element body 10, and when the void 51 is present in contact with the coil conductor layer 21, the vicinity area E is present within 20 μm from the boundary surface between the void 51 and the magnetic layer included in the element body 10.

In FIG. 4, an alternate long and short dash line is provided so as to surround the coil conductor layer 21 and the void 51. The area surrounded by the alternate long and short dash line in the element body 10 is an example of the vicinity area E.

The pore area rate in the vicinity area E is, for example, 1% or less, and specifically, 0.5% or less. Because the vicinity area E has a pore area rate as described above, the insulation between the coil conductor layers adjacent to each other can be further enhanced in the coil component 1. Furthermore, because the vicinity area E has a pore area rate as described above, even when the thickness of the magnetic layer present between the coil conductor layers 21 is thin, the insulation between the coil conductor layers 21 adjacent to each other is further maintained.

Note that only the vicinity area E may be present, or the vicinity area E and an area other than the vicinity area E may be present between the opposing faces of the coil conductor layers adjacent to each other. In other words, the entire first area Z1 may be included in the vicinity area E, or the first area Z1 may include an area that is not included in the vicinity area E.

As shown in FIG. 4, the coil component 1 has a first same-layer area Z21 that is the second area Z2 present in the same layer as the coil conductor layer 21, and a second same-layer area Z22 that is the second area Z2 present in the same layer as the first area Z1.

It is preferable that the pore area rate in the first area Z1 be less than the pore area rate in the first same-layer area Z21 and the pore area rate in the second same-layer area Z22. It is more preferable that the pore area rate in the vicinity area E be less than the pore area rate in the first same-layer area Z21 or the pore area rate in the second same-layer area Z22.

The pore area rate in the first same-layer area Z21 is, for example, 1.5% or more, and specifically 2% or more and 8% or less (i.e., from 2% to 8%). The pore area rate in the second same-layer area Z22 is, for example, 1.0% or more, or 1.5% or more, and specifically 2% or more and 8% or less (i.e., from 2% to 8%).

It is more preferable that the pore area rate in the second same-layer area Z22 be less than the pore area rate in the first same-layer area Z21.

With the pore area rate as described above, the leak can be well suppressed not only from the opposing faces of the coil conductor layers adjacent to each other, but also from the side of the coil.

In one aspect, the second area Z2 can include a central area that is in an area within a predetermined range from the central axis of the coil in the element body 10. The pore area rate in the first area Z1 is preferably less than the pore area rate in the central area.

With such a configuration, the pore area rate in the central area of the element body can be increased, the dissipation of the heat generated by the coil can be improved, and the internal stress can be relaxed by the pores even when heat or external stress is applied to the element body.

Here, the term "central area" means an area within 10 μm from the central axis of the coil when viewed along the T axis of the coil.

The pore area rate in the central area is, for example, 1.0% or more, or 1.5% or more, and specifically 2% or more and 8% or less (i.e., from 2% to 8%).

Next, an example of a method for manufacturing the coil component 1 will be described with reference to FIGS. 5A to 5E and 6A to 6B.

FIGS. 5A to 5E show a section in the width direction of the coil conductor layer 21, in other words, a section orthogonal to the extending direction of the coil conductor layer 21.

First, a first magnetic sheet 211 included in the first magnetic layer 11 is provided. The first magnetic sheet 211 can be prepared by, for example, molding a magnetic slurry containing a magnetic ferrite material 111 into a sheet shape and, if necessary, processing the sheet-shaped slurry by punching or the like. In addition, a predetermined portion in the first magnetic sheet 211 is irradiated with a laser to form a through hole.

Examples of the method for processing the magnetic slurry into a sheet shape include a doctor blade method. The obtained sheet has a thickness of, for example, 15 μm or more and 25 μm or less (i.e., from 15 μm to 25 μm).

The composition of the magnetic ferrite material 111 is not particularly limited, and, for example, a material containing $Fe_2O_3$, ZnO, CuO, and NiO can be used. When the magnetic ferrite material 111 contains $Fe_2O_3$, ZnO, CuO, and NiO, the content of $Fe_2O_3$ is, for example, in the range of 40.0 mol % or more and 49.5 mol % or less (i.e., from 40.0 mol % to 49.5 mol %), the content of ZnO is, for example, in the range of 5 mol % or more and 35 mol % or less (i.e., from 5 mol % to 35 mol %), the content of CuO is, for example, in the range of 8 mol % or more and 12 mol % or less (i.e., from 8 mol % to 12 mol %), and the content of NiO is, for example, in the range of 8 mol % or more and 40 mol % or less (i.e., from 8 mol % to 40 mol %). The magnetic ferrite material 111 can further contain an additive. Examples of the additive include $Mn_3O_4$, $Co_3O_4$, $SnO_2$, $Bi_2O_3$, and $SiO_2$.

The magnetic ferrite material 111 is wet-mixed and wet-ground by an ordinary method, and then dried. The resulting dried product is calcined at 700° C. or more and less than 800° C. (i.e., from 700° C. to 800° C.), specifically 700° C. or more and 720° C. or less (i.e., from 700° C. to 720° C.) to form a raw material powder 112. Note that there is a possibility that the raw material powder (calcined powder) 112 will contain an inevitable impurity.

An aqueous acrylic binder and a dispersant are added to the raw material powder 112, and the mixture is wet-mixed and wet-ground to prepare a magnetic slurry. The wet-mixing and wet-grinding can be performed by, for example, putting in a pot mill together with a partially stabilized zirconia (PSZ) ball.

On the first magnetic sheet 211, for example, a resin material is screen-printed to form a burned-out portion 41. The burned-out portion 41 is a portion that is to be burned out by firing, and the burned-out portion 41 is burned out to form the void 51 in the coil component 1 at the firing process. As the resin material, a paste material containing a resin and a solvent can be used. Examples of the resin include a resin that is burned out during firing, such as an acrylic resin. Examples of the solvent include a solvent that is burned out during firing, such as isophorone.

A coil conductor composition 221 included in the coil conductor layer 21 is provided by, for example, screen-printing so that the coil conductor composition 221 and the burned-out portion 41 are stacked. The coil conductor composition 221 may be, for example, a paste, and specifically, a paste containing an Ag powder, a solvent, a resin, and a dispersant can be used. Examples of the solvent include eugenol, and examples of the resin include an ethyl cellulose. In preparing the above-described paste conductor composition, an ordinary method can be used. For example, the paste conductor composition can be prepared by mixing the Ag powder, the solvent, the resin, and the dispersant with a planetary mixer, and then dispersing the mixture with a three-roll mill.

A magnetic paste 213 included in a coating layer 13 is provided so as to cover the burned-out portion 41 and the coil conductor composition 221. The magnetic paste 213 is not particularly limited, and is prepared by, for example, screen-printing a first magnetic paste shown below.

The first magnetic paste is a paste composition, and can be formed by, for example, kneading a solvent, a raw material powder 132 that is prepared by calcining a magnetic ferrite material 131, a resin, and a plasticizer with a planetary mixer, and then dispersing the mixture with a three-roll mill. Examples of the solvent include a ketone-based solvent, examples of the resin include polyvinyl acetal, and examples of the plasticizer include an alkydbased plasticizer. As the magnetic ferrite material 131 and the raw material powder 132, the same materials as the magnetic ferrite material 111 and the raw material powder 112 can be used.

Then, a second magnetic composition 212 included in the second magnetic layer 12 is provided on the first magnetic sheet 211 in the same layer as the coil conductor composition 221. The second magnetic composition 212 can be formed by screen-printing a second magnetic paste described below.

The second magnetic paste is a paste composition, contains a solvent, a raw material powder 122, a resin, and a plasticizer, and can be formed by kneading these components with a planetary mixer, and then dispersing the mixture with a three-roll mill.

The raw material powder 122 can be prepared by calcining a magnetic ferrite material 121. As the magnetic ferrite material 121, the same material as the magnetic ferrite material 111 is used. The calcined magnetic ferrite material 121 can be prepared by wet-mixing and wet-grinding in which an ordinary method is used, and then drying the resulting product, and calcining the resulting dried product at 800° C. or more and 820° C. or less (i.e., from 800° C. to 820° C.). Note that there is a possibility that the raw material powder 122 will contain an inevitable impurity.

The coil conductor layer 21 is formed on the first magnetic layer 11 by the method shown in FIGS. 5A to 5E described above.

By forming the coil conductor layer 21 as described above, the pore area rate in the second magnetic layer 12 is more than the pore area rate in the first magnetic layer 11. Specifically, by the forming as described above, the pore area rate in the second magnetic layer 12 was 2.9%, and the pore area rate in the first magnetic layer 11 was 1.7%.

The reason why the pore area rate has such a relationship is considered as follows. The raw material powder 122 contained in the second magnetic paste used for forming the second magnetic layer 12 is formed at a higher calcination temperature than the raw material powder 112 used for forming the first magnetic layer 11. As a result, the density of the second magnetic layer 12 is relatively lower than the density of the first magnetic layer 11. That is, the pores included in the second magnetic layer 12 increases, and the pore area rate in the second magnetic layer 12 is more than the pore area rate in the first magnetic layer 11.

Furthermore, by forming the coil conductor layer 21 as described above, the pore area rate in the second magnetic layer 12 is more than the pore area rate in the coating layer 13. Specifically, the pore area rate in the second magnetic layer 12 was 2.9%, and the pore area rate in the coating layer 13 was 0.2%.

The reason why the pore area rate has such a relationship is considered as follows. The raw material powder 122 contained in the second magnetic paste used for forming the second magnetic layer 12 is formed at a higher calcination temperature than the raw material powder 132 contained in the first magnetic paste used for forming the coating layer 13. As a result, the density of the second magnetic layer 12 is relatively lower than the density of the coating layer 13. That is, the pores included in the second magnetic layer 12 increases, and the pore area rate in the second magnetic layer 12 is more than the pore area rate in the coating layer 13.

Figure 6A:
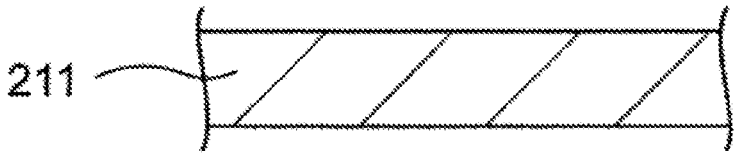
FIG. 6A is an explanatory view illustrating an example of a method for manufacturing a coil component.
Figure 6B:
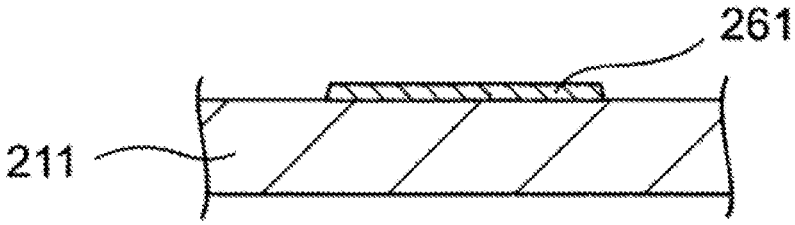
FIG. 6B is an explanatory view illustrating an example of the method for manufacturing a coil component.

As shown in FIG. 6A, the extended conductor layer 61 is formed by, first, preparing the first magnetic sheet 211, and then, as shown in FIG. 6B, screen-printing a second conductor paste 261 on the first magnetic sheet 211. The extended conductor layer 62 is also formed in the same manner as the extended conductor layer 61.

The second conductor paste 261 is a paste composition, contains 100 parts by weight of an Ag powder and 0.2 parts by weight or more and 1.0 part by weight or less (i.e., from 0.2 parts by weight to 1.0 part by weight) of a ceramic powder such as $Al_2O_3$ or $ZrO_2$, and is formed by dispersing these components. $Al_2O_3$ and $ZrO_2$ suppress the sintering of Ag during firing. Therefore, when $Al_2O_3$ and $ZrO_2$ are contained, the growth of an Ag grain can be suppressed. As a result, the average crystal grain size of the extended conductor layer 61 can be less than that of the coil conductor layer 21.

A laminate block is prepared by thermal pressure bonding of the above-described constituents. At this time, the pore area rate of the first magnetic layer 11 corresponding to the first area Z1 can be reduced by the thermal pressure bonding.

Then, the formed laminate block is subjected to an ordinary operation such as separation, firing, or formation of an external electrode to form a coil component 1. The separation, the firing, and the formation of an external electrode can be performed using an ordinary method. For example, the separation can be performed by cutting the obtained laminate block with a dicer or the like. If necessary, a rotary barrel is used to round the corner and the like. The firing can be performed at a temperature of 880° C. or more and 920° C. or less (i.e., from 880° C. to 920° C.). The formation of an external electrode can be performed by immersing the end face with the exposed extended conductor layer in a layer in which an Ag paste is extended to a predetermined thickness, baking the end face at a temperature of about 800° C. to form a base electrode, and then forming a Ni film and a Sn film in order on the base electrode by electrolytic plating.

Second Embodiment

Figure 7:
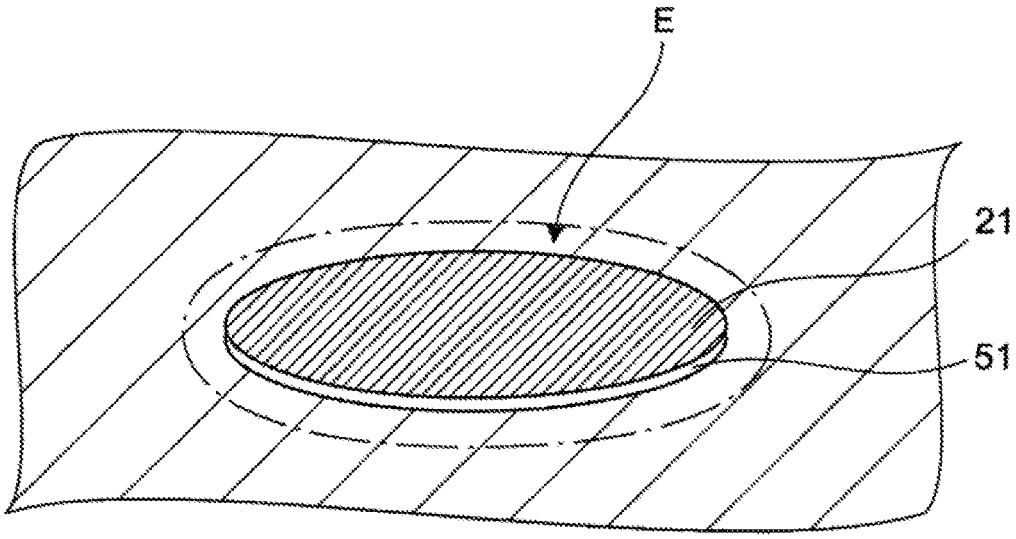
FIG. 7 is an enlarged sectional view of a coil component in a second embodiment in the vicinity of a coil conductor layer.

FIG. 7 is an enlarged sectional view showing a coil conductor layer 21 included in a coil component 1 in a second embodiment and a void 51 provided on the lower face of the coil conductor layer 21. In the present embodiment, the coil conductor layer 21 has an elliptical shape. In the second embodiment, the configuration is the same as that of the coil component 1 in the first embodiment, except that the coil conductor layer 21 has the shape shown in FIG. 7. Descriptions of the same configuration as that in the first embodiment will be omitted.

What is claimed is:

1. A coil component comprising:

an element body including magnetic layers; and a coil provided in the element body and spirally wound along a first direction, the coil having a plurality of coil conductor layers stacked along the first direction, the element body having a first area between the coil conductor layers adjacent to each other along the first direction and having a second area other than the first area, the second area being directly adjacent to the first area on both sides of the first area in a same one of the magnetic layers, the first area having a pore area rate less than a pore area rate in at least a portion of the second area, the element body having a vicinity area located in a vicinity of each of the coil conductor layers, the second area including an out-of-vicinity area other than the first area, the out-of-vicinity area located outside the vicinity area, the pore area rate in the first area being less than a pore area rate in the out-of-vicinity area, a pore area rate in the vicinity area being less than the pore area rate in the out-of-vicinity area, and the vicinity area being limited to within 20 μm or less from a surface of the coil conductor layer.

2. The coil component according to claim 1, wherein the second area includes a central area located around a central axis of the coil, and the pore area rate in the first area is less than a pore area rate in the central area.

3. The coil component according to claim 1, wherein the pore area rate in the first area is 1% or less.

4. The coil component according to claim 1, wherein the pore area rate in the first area is 0.5% or less.

5. The coil component according to claim 1, wherein a difference between the pore area rate in the first area and the pore area rate in at least a portion of the second area is 1% or greater.

6. The coil component according to claim 1, wherein the pore area rate in at least a portion of the second area is from 2% to 8%.

7. The coil component according to claim 1, wherein the element body further includes a void, and the void is located between the coil conductor layers adjacent to each other along the first direction, and is in contact with one coil conductor layer of the coil conductor layers adjacent to each other.

8. The coil component according to claim 2, wherein the pore area rate in the first area is 1% or less.

9. The coil component according to claim 2, wherein the pore area rate in the first area is 0.5% or less.

10. The coil component according to claim 3, wherein the pore area rate in the first area is 0.5% or less.

11. The coil component according to claim 3, wherein a difference between the pore area rate in the first area and the pore area rate in at least a portion of the second area is 1% or greater.

12. The coil component according to claim 2, wherein a difference between the pore area rate in the first area and the pore area rate in at least a portion of the second area is 1% or greater.

13. The coil component according to claim 3, wherein the pore area rate in at least a portion of the second area is from 2% to 8%.

14. The coil component according to claim 2, wherein the pore area rate in at least a portion of the second area is from 2% to 8%.

15. The coil component according to claim 3, wherein the element body further includes a void, and the void is located between the coil conductor layers adjacent to each other along the first direction, and is in contact with one coil conductor layer of the coil conductor layers adjacent to each other.

16. The coil component according to claim 2, wherein the element body further includes a void, and the void is located between the coil conductor layers adjacent to each other along the first direction, and is in contact with one coil conductor layer of the coil conductor layers adjacent to each other.

17. The coil component according to claim 1, wherein the element body further includes a void, and the first area is directly adjacent to the void.

* * * * *